US006092890A

United States Patent [19]

Wen et al.

[11] Patent Number: 6,092,890

[45] **Date of Patent: *Jul. 25, 2000**

[54] PRODUCING DURABLE INK IMAGES

[75] Inventors: Xin Wen; Charles E. Romano, both of Rochester, N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/070,260

[22] Filed: Apr. 30, 1998

Related U.S. Application Data

[63] Continuation of application No. 08/934,370, Sep. 19, 1997.

[51] Int. Cl.[7] ..... B41J 2/01

[52] U.S. Cl. ..... 347/101

[58] Field of Search ..... 347/101, 102

[56] References Cited

U.S. PATENT DOCUMENTS

| | | | |
|---|---|---|---|
| 4,303,924 | 12/1981 | Young, Jr. | 347/102 |
| 4,340,893 | 7/1982 | Ort | 347/102 |
| 4,833,486 | 5/1989 | Zerillo | 342/2 |
| 5,275,646 | 1/1994 | Marshall et al. | 106/31.32 |
| 5,534,904 | 7/1996 | Sheinman | 347/75 |
| 5,605,750 | 2/1997 | Romano et al. | 428/304.4 |
| 5,611,847 | 3/1997 | Guistina et al. | 106/31.43 |
| 5,625,391 | 4/1997 | Hirabayashi et al. | 347/41 |
| 5,797,329 | 8/1998 | Okada | 101/488 |

FOREIGN PATENT DOCUMENTS

| | | |
|---|---|---|
| 407054A1 | 1/1991 | European Pat. Off. . |
| 488530A2 | 6/1992 | European Pat. Off. . |
| 533168A1 | 3/1993 | European Pat. Off. . |

OTHER PUBLICATIONS

Edmund Scientific under the catalogue numbers of C40,759, C40,760, and C40,765 etc.

*Primary Examiner*—John Barlow
*Assistant Examiner*—Charles W. Stewart, Jr.
*Attorney, Agent, or Firm*—Raymond L. Owens

[57] ABSTRACT

Apparatus for providing an images on a receiver in response to a digital image, includes a print head adapted to transfer radiation curable inks on the receiver to form image pixels on the receiver, and a radiation source adapted to apply radiation for treating inks transferred on the receiver. The apparatus provides relative movements between the receiver, the print head, and the radiation source; and has circuitry coupled to the print head and the radiation source, and for providing relative movements in at least two directions between the receiver, the print head, and the radiation source, and for causing the print head in response to the digital image to deliver radiation curable inks to the receiver and for treating such delivered inks to thereby produce an image on the receiver.

7 Claims, 4 Drawing Sheets

PRODUCING DURABLE INK IMAGES

CROSS REFERENCE TO RELATED APPLICATIONS

This patent application is a continuation Ser. No. 08/934,370, filed Sep. 19, 1997 entitled "Ink Jet Printing with Radiation Treatment" to Wen. The disclosure of this related application is incorporated herein by reference.

FIELD OF THE INVENTION

The present invention relates to apparatus for providing a durable ink image on a receiver.

BACKGROUND OF THE INVENTION

Physical durability, light fastness, and water fastness are the necessary requirements in many hard-copy imaging applications. Examples of such applications include outdoor signage, prints for security purposes such as passports or ID (identification) cards, CD (compact disk) labels, and lithographic printing plate.

Among the various digital output technologies, ink jet has the advantages of being non-impact, and having low-noise, low energy use, and low cost operation in addition to having the capability of being able to print on plain paper. These are largely responsible for the wide acceptance of ink jet apparatus in the marketplace.

An ink jet apparatus produces images on a receiver by ejecting ink droplets onto the receiver in an imagewise fashion. A frequently occurring problem associated with ink jet printing is excessive laydown of inks on the ink receiver. Image defects are often formed when inks are placed on the receiver at an amount or rate higher than the receiver can accept. For example, the ink spots placed at neighboring pixels on a receiver can come in contact with each other and coalesce, forming an image artifact commonly referred as "ink coalescence". Coalescence of ink spots on the receiver causes inks to diffuse or flow among ink pixels and results in a non-uniform or mottled appearance of the printed image. This ink diffusion problem is most visible at the boundaries of printed areas comprising different colors, where the ink of one color diffuses into the adjacent area of a different color ink to form a finger-shaped pattern. This latter image defect is commonly referred to as "color bleeding". Another need in ink jet printing is to provide an image on a receiver that is durable against physical abrasion.

SUMMARY OF THE INVENTION

An object of this invention is to provide ink images with superior physical durability, light fastness, and water fastness.

A further object of this invention is to provide an ink jet apparatus which avoids the common image defects such as coalescence and color bleeding in ink jet printing.

An additional object of the present invention is to provide ink jet prints that are physically durable.

These objects are achieved by an apparatus for providing images on a receiver in response to a digital image, comprising:

a) print head means adapted to transfer radiation curable inks on the receiver to form image pixels on the receiver;

b) a radiation source adapted to apply radiation for treating inks transferred on the receiver;

c) means for providing relative movements between the receiver, the print head means, and the radiation source; and d) control means coupled to the print head means and the radiation source, and the relative movement means and for providing relative movements in at least two directions between the receiver, the print head means, and the radiation source, and for causing the print head in response to the digital image to deliver radiation curable inks to the receiver and for treating such delivered inks to thereby produce an image on the receiver.

ADVANTAGES

A feature of this invention is that image artifacts such as coalescence and color bleeding are reduced by the radiation treatment of the radiation-curable inks.

Another feature of this invention is that the radiation is conducted immediately after the placement of the ink spots on the ink receiver.

DETAILED DESCRIPTION OF THE INVENTION

The present invention is described with relation to an ink jet printing apparatus for improved physical durability and stability of the printed images.

Figure 1:
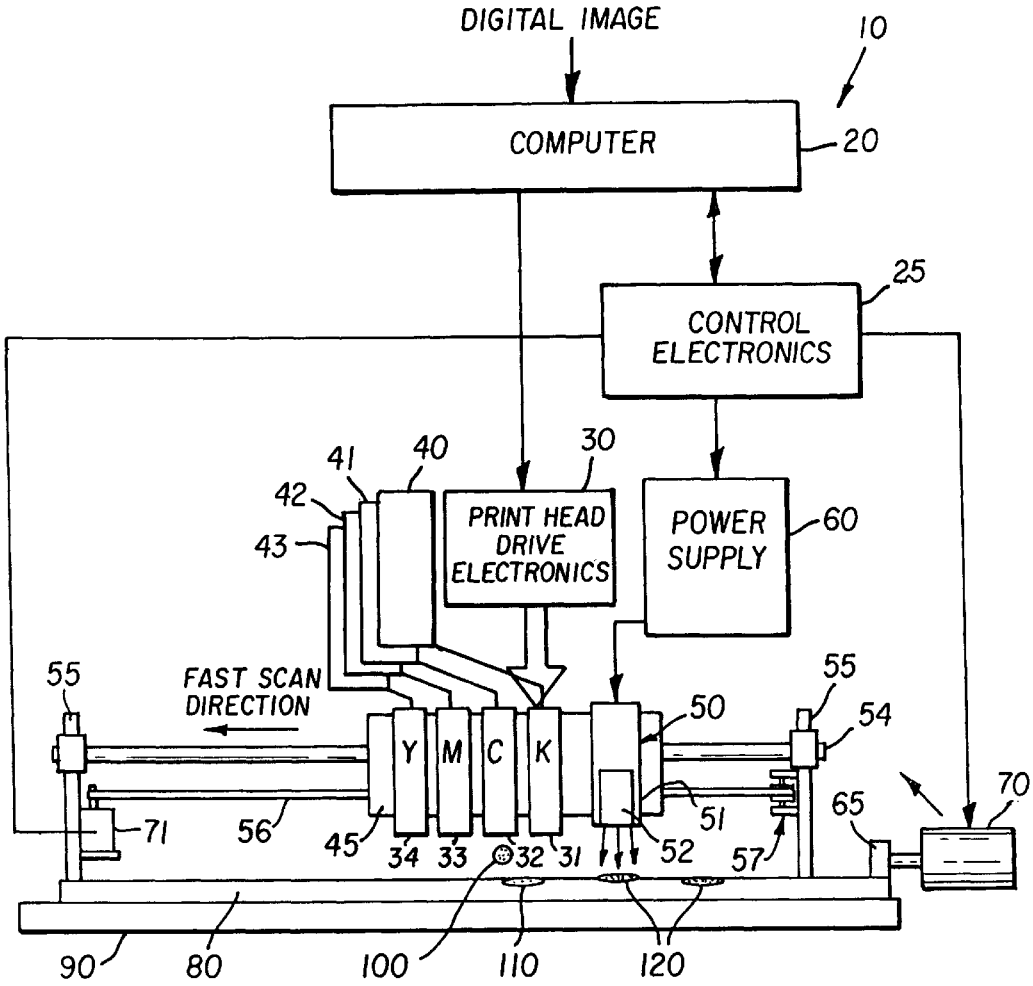
FIG. 1 is a schematic diagram of the ink jet printing apparatus in the present invention.

Referring to FIG. 1, an ink jet printing apparatus 10 is shown to comprise a computer 20, control electronics 25, print head drive electronics 30, ink jet print heads 31–34 for printing black ink (K), cyan ink (C), magenta ink (M), and yellow ink (Y), a plurality of ink reservoirs 40–43 for providing respective colored inks to the print heads 31–34, a compact UV light source 50 and the power supply 60 for the compact UV light source 50, a first motor 70, an ink receiver 80, and a platen 90. The print heads 31–34 and the compact UV light source are fixed to a holder 45 which can be transported by a second motor 71 along the gliding rail 54 in the fast scan direction (as indicated in FIG. 1). The gliding rail is supported by supports 55. The print heads 31–34, the compact UV light source 50, and the holder 45 are transported by several mechanisms, shown in FIG. 1. More specifically, there is shown a belt 56, a pulley mechanism 57, and the second motor 71. The second motor 71 can be a stepping motor, or alternatively can be a DC motor with a servo system. The receiver 80 is supported by the platen 90. The receiver can be transported by the first motor 70 with a roller 65 in a direction (i.e. slow scan) orthogonal to the fast scan direction. It is appreciated that both the first motor 70 and the second motor 71 are bi-directional so that the print heads 31–34, the compact UV source 50, and the receiver 80 can be transported back to the starting position.

The computer 20 controls the control electronics 25 which in turn controls the power supply 60, the first motor 70 and the second motor 71. The power supply 60 provides an input voltage to the compact UV light source 50. The computer 20 also controls the print head control electronics 30 which prepares electrical signals to drive the print heads 31–34 according to the data of the digital image. The print heads 31–34 can exist in different forms, for example, piezoelectric or thermal ink jet print head. An example of such a print head is shown in commonly assigned U.S. Pat. No. 5,598,196. The radiation curable inks stored in the reservoirs 40–43 are supplied to the print head 31–34.

The compact UV source 50 can include a shield 51 and a UV lamp 52. The UV lamp can be shielded in a glass tube that absorbs visible light while permitting the transmittance of UV light. The glass tube also protects the UV lamp from physical damages. A typical compact UV lamp can be 5 inch long, 0.5 inch in diameter, and 70 gram in weight. Such compact UV lamps are available, for example, from Edmund Scientific under the catalogue numbers of C40,759, C40,760, and C40,765 etc. The light weight and the compact size of the compact UV source 50 permit it to be installed together with the print heads 31–34 on the holder 45. It will be appreciated that the compact UV source does not have to be mounted on the holder 45 but can be separately moved under the control of the control electronics 25. Other forms of radiation are also compatible with the present invention. Such forms of radiation can include the application of photons at frequencies other than UV or particles such as beam of electrons.

An input digital image can be applied to, or produced in the computer 20. The digital image is processed in the computer 20 by image processing algorithms such as tone scale conversion, color mapping, halftoning etc. The computer 20 sends the signals representing the digital image to the print head drive electronics 30 that in turn prepares electrical signals for the print heads 31–34 according to the digital image data. During each printing pass, the print heads 31–34 and the compact light source are transported under the control of the control electronics 25 along the fast scan direction as described above. The print heads 31–34 transfer colored ink drops 100 to the receiver 80 during each printing pass, which forms ink spots 110 on the receiver 80. After each printing pass, the receiver can be transported by the first motor 70 under the control of the control electronics 25 in a direction that is perpendicular to the fast scan direction. Each printed image is typically formed by a plurality printing passes. The ink spots 110 on the receiver 80 are treated by a compact UV light source 50 which is powered by the power supply 60 also under the control of the control electronics 25.

The receiver 80 can be common paper having sufficient fibers to provide a capillary force to draw the ink from the mixing chambers into the paper. Synthetic papers can also be used. The receiver can comprise a layer(s) that is porous to the inks, an ink absorbing layer(s), as well as materials with a strong affinity and mordanting effect for the inks. Exemplary receivers are disclosed in U.S. Pat. No. 5,605,750. The printed images can be used for outdoor signages, bill boards, and displays. The present invention also addresses many other applications in which image durability is required: security printing such as passports or ID cards, CD, and lithographic printing plates and so on. In the present invention, the printing on a ink receiving sheet of the passport includes the printing of the personal data page in the passport booklet in which security, physical durability and image stability are all important. ID cards refers to identification cards, bank cards, phone cards which can include graphic and text symbols as well as pictorial images. The term CD refers to CD-ROM, CD-R, DVD and other types of optical storage disks. The CD label is understood to those skilled in the art to include digital data such as bar codes, analog data such as text, graphics such as line art, pictorial information such as colored images or combinations thereof and the like. The receiver 80 in the present invention can include lithographic plates that are mounted in a lithographic press for printing as well as the surface of the plate cylinder of the lithographic press. The above mentioned applications all require different aspects of image durability. For example, outdoor signage requires good strength against physical abrasion and waterfastness. The printed images on passports or ID cards require high physical strength to prevent wearing and counterfeiting. The lithographic plates require high physical abrasion durability for improving printing lifetime of the plates.

The ink colors compatible with the present invention can include yellow, magenta, cyan, black, red, green, blue, and other colors. Several ink densities can also be used for each color. The inks can include dyes or pigments. The inks in the present invention can also be colorless or not intended for color visual effects, for example, the inks used for producing lithographic printing plates such as the ink compositions as disclosed in U.S. Pat. No. 4,833,486 and EP 488,530A2. The examples of the colored inks used in this invention are found in U.S. Pat. No. 5,611,847, as well as the following commonly assigned U.S. patent application Ser. No. 08/699,955; Ser. No. 08/699,962; Ser. No. 08/699,963; Ser. No. 08/790,131; and Ser. No. 08/764,379; the disclosures of which are incorporated by reference herein. Colorants such as the Ciba Geigy Unisperse Rubine 4BA-PA, Unisperse Yellow RT-PA, and Unisperse Blue GT-PA can also be used in the inks of the present invention.

The inks in the present invention also comprise substances that can be cured by UV-irradiation and other types of radiation such as photo-initiators and photo-activators in addition to the colorants, stabilizers, surfactants, viscosity modifiers, humectants and other components in the ink formula. In the present invention, the term cure refers to the processes that harden or solidify the inks in the receiver 80, which can be polymerization, reaction, glass transition, and other similar processes. The curing of the inks on the receiver 80 greatly improves the physical durability as well as the image stability (such as water fastness and light fastness) of the printed ink image. UV curable inks are known to a person skilled in the art of inkjet printing. A range of commercial monomers, e.g. having acrylic, vinyl or epoxy functional groups, photo-initiators and photo-activators is available and suitable for use in an ink jet formulation, capable of polymerization by UV light. The reaction may proceed through addition polymerization; all reactants are converted to the final polymeric binder, leaving no by-product or trace of liquid. This reaction can proceed in two processes, either by a free-radical mechanism or by the formation of a cationic species, or combination of both processes. UV curable ink compositions can be found in U.S. Pat. No. 4,303,924, U.S. Pat. No. 5,275,646, and EP Patent Publication No. 407054, EP Patent 488,530 A2, and EP Patent 533,168 A1.

Figure 2:
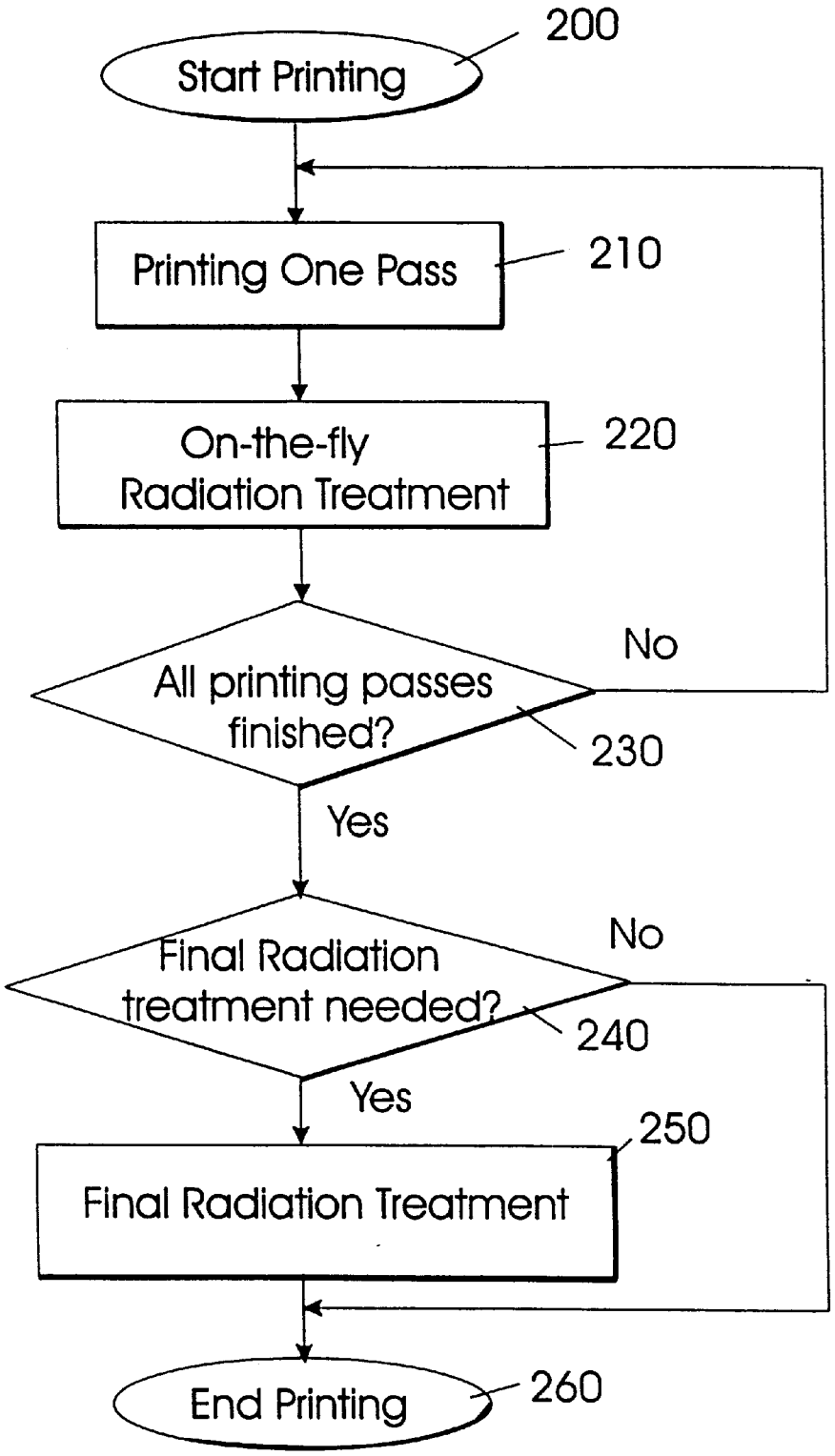
FIG. 2 is a flow chart of the operation of the apparatus of FIG. 1.
Figure 3:
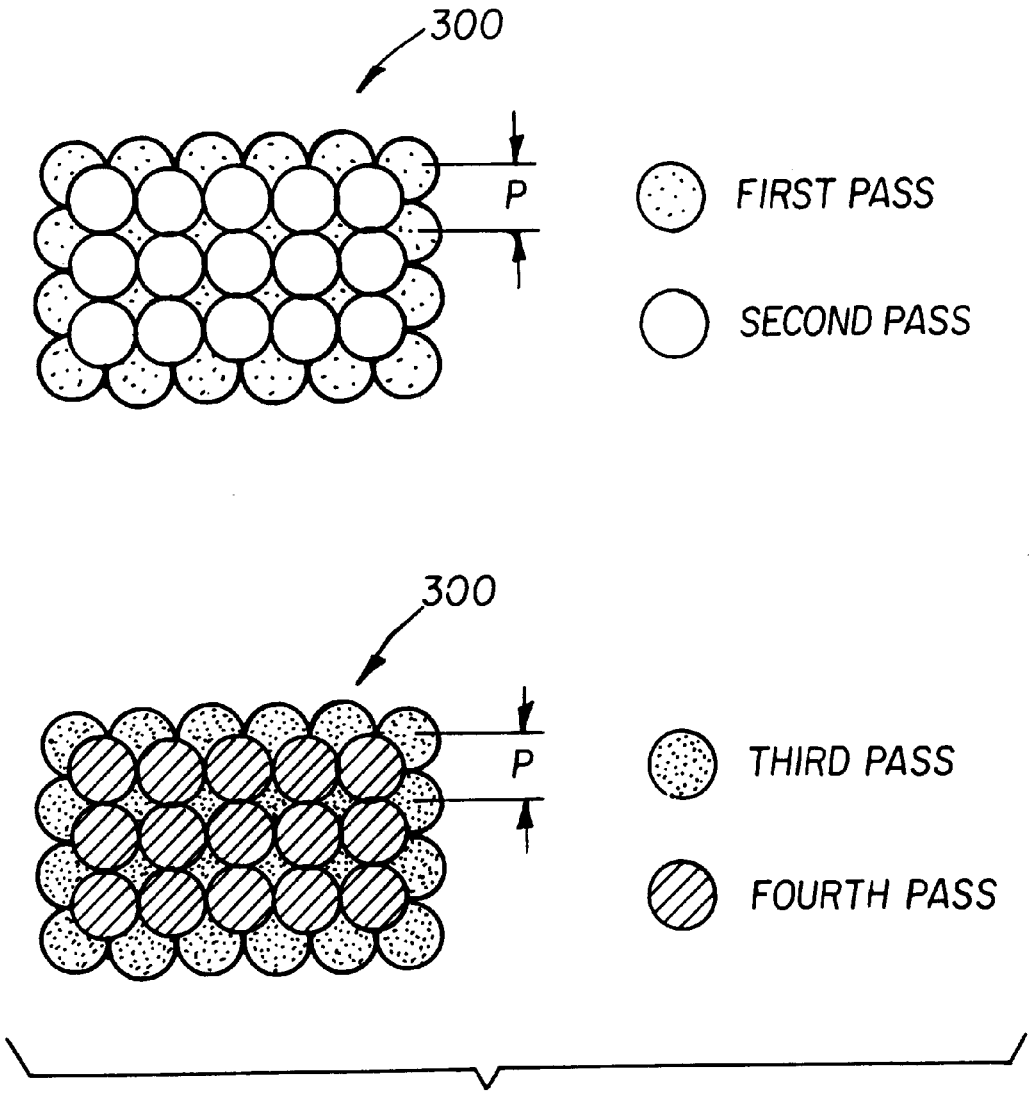
FIG. 3 illustrates the subsets of pixels that are addressed in each printing passes for reducing ink coalescence.

A flow chart of the operation of the inkjet printing apparatus 10 of FIG. 1 is shown in FIG. 2. The printing operation is started in block 200 in which the computer 20 receives or generates a digital image. The control electronics 25 controls the first motor 70 to move the receiver 80 under the print heads 31–34. In the first printing pass in block 210, the control electronics 25 sends control signals to the print head 30 according to the input digital image to transfer ink drops 100 to the receiver 80. As the area marked with the ink spots 110 is transported to the compact UV light source 50, the control electronics 25 sends control signal to the power supply 60 to activate the compact UV light source 50 to cure the ink spots 110 on the receiver 80 during the first pass, as shown in block 220. The cured ink spots are indicated by the ink spots 120 on the receiver 80. Since the radiation treatment by the compact UV source 50 (as shown in FIG. 1) in block 220 is implemented on-the-fly, no additional time is required for the printing pass. As illustrated in FIGS. 3 and 4, the radiation treatment by the compact UV light source 50 solidifies the ink spots 110, which prevents ink coalescense in this printing pass as well as coalescence with the ink spots placed in the subsequent printing passes. Next in block 230, a question is asked whether the printing is finished or not, if not, the subsequent printing passes will be in the sequence of ink transfer and radiation treatment in each printing pass in blocks 210 and 220. After all the printing passes are finished, a question is asked in block 240 about whether an additional final radiation treatment is needed. If the answer is no, the printing is finished in block 260. If the answer is yes, a final radiation treatment is performed by the compact UV source 50 (as shown in FIG. 1) in block 250. The control electronics 25 causes the first motor 70 to move the receiver 80 below the compact UV light source 50 that is concurrently activated by the control electronics 25. The last radiation treatment further enhance the curing of all the inks transferred on receiver 80. Because the last radiation treatment is not conducted "on-the-fly" during the ink transfer, the irradiation time can be optimized by for example, controlling the receiver transport speed.

The present invention can be further understood with reference to FIGS. 3, and FIGS. 4*a*–4*d*. In FIG. 3, the addressable pixels 300 on receiver 80 in each printing pass are illustrated. As an example, four printing passes are illustrated. The addressable pixels 300 represent the pixels on receiver 80 that can be printed by the print heads 31–34 in each printing pass. They are a subset of total pixels in the printed image on the receiver. The pixels that are printed correspond to a subset of pixels. In each pass different subsets of pixels are transferred to the receiver. The subset of pixels and their position on the receiver are determined by the computer 20 in response to the digital image data and the previous positions where pixels were formed. The layout of the subset of pixels in each printing pass is arranged to minimize the coalescence of the ink spots 110 which reduces the formation of image artifacts as described above. The pixels printed in all the passes together form the printed image corresponding to the digital image.

Figure 4A:
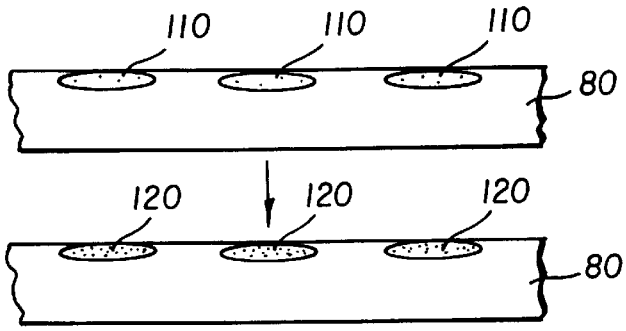
FIGS. 4*a*–4*d* illustrate a series of four different passes to form a colored output image on a receiver which can be accomplished by the apparatus of FIG. 1.
Figure 4B:
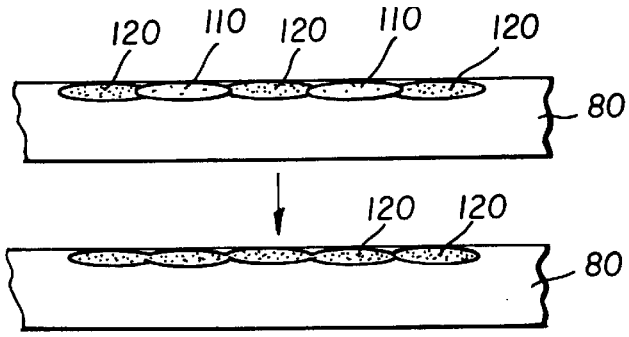
Figure 4C:
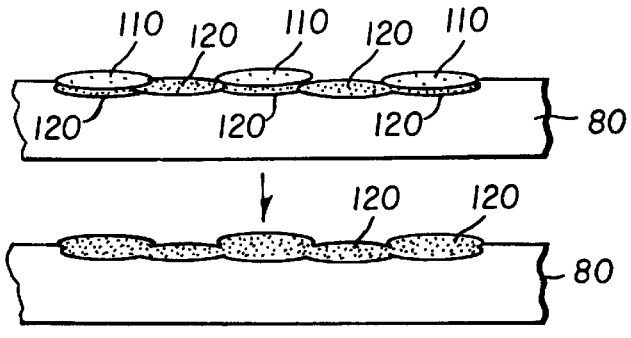
Figure 4D:
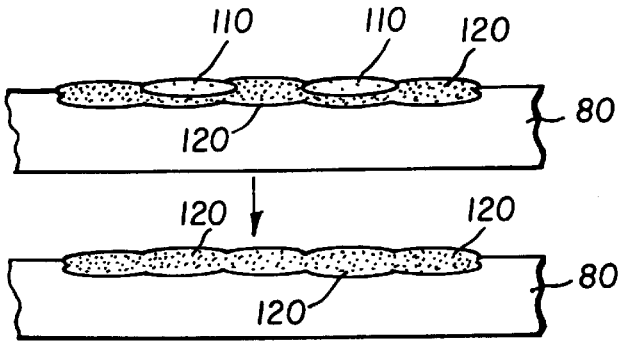

The operation of the ink jet printing apparatus 10 of FIG. 1 is further illustrated in four separate passes in FIGS. 4*a*–4*d*. In the first printing pass, shown in FIG. 4*a*, a plurality of ink spots 110 are placed at a subset of pixels on the receiver 80. Immediately following the ink transfer, the ink spots 110 are cured by UV irradiation to form cured ink spots 120 while the receiver is transported by the first motor 70. This radiation curing of ink spots 110 prevent coalescence between these ink spots as well as coalescence of these ink spots with other ink spots transferred in the following passes. Following the first printing pass, additional ink spots 110 are transferred in the second pass, as shown in FIG. 4*b*, which is again followed by a UV radiation treatment. In FIGS. 4*c* and 4*d*, the similar ink-transfer and radiation-treatment steps are repeated in the third and the fourth passes.

The invention has been described in detail with particular reference to certain preferred embodiments thereof, but it will be understood that variations and modifications can be effected within the spirit and scope of the invention.

PARTS LIST

10 ink jet printing apparatus
20 computer
21 control electronics
30 print head drive electronics
31 ink jet print head
32 ink jet print head
33 ink jet print head
34 ink jet print head
40 ink reservoir
41 ink reservoir
42 ink reservoir
43 ink reservoir
45 holder
50 compact UV light source
51 shield
52 UV lamp
54 gliding rail
55 support
56 belt
57 pulley mechanism
60 power supply
65 roller
70 first motor
71 second motor
80 ink receiver
90 platen
100 ink drop PARTS LIST (con't)

110 ink spot
120 cured ink spot
200 start printing
210 printing one pass
220 on-the-fly radiation treatment
230 all the printing passes finished
240 final radiation treatment needed
250 final radiation treatment
260 end printing
300 addressable pixels

What is claimed is:

1. Apparatus for providing an image on a receiver in response to a digital image, comprising:

a) a set of print heads for ejecting UV radiation curable ink drops on the receiver to form image pixels on the receiver;

b) a single UV radiation light source associated with the print head set for applying radiation for curing inks by hardening or solidifying ink drops on the receiver;

c) means for providing relative movements between the receiver, the print heads, and the UV radiation light source; and d) control means coupled to the relative movement means for causing the relative movement means to provide relative movements in at least two directions between the receiver, the print heads, and the radiation source, and for causing the print head to print a print area in multiple passes in response to the digital image to deliver radiation curable inks in multiple layers to the area of the receiver and for curing each delivered ink layer during each printing pass to thereby produce an image on the receiver.

2. The apparatus of the claim 1 wherein the control means includes means for moving the print heads and the radiation source in a first direction relative the receiver and means for moving the receiver in a second direction orthogonal to the first direction and relative to the print head means and the radiation source.

3. The apparatus of claim 1 further including means for mounting the print heads and the radiation means for simultaneous movement in a first direction relative to the receiver and means for moving the receiver in a second direction orthogonal to the first direction, and relative to the print heads and the radiation source.

4. The apparatus according to claim 3 wherein the control means includes a power supply for controlling the power applied to the radiation source.

5. Apparatus for providing an image on a receiver in response to a digital image, comprising:

a) a set of print heads for ejecting UV radiation curable ink drops on the receiver to form image pixels on the receiver;

b) a single UV radiation light source associated with the print head set for applying UV radiation for curing inks by hardening or solidifying ink drops transferred on the receiver;

c) means for moving the print heads and the UV radiation light source in a first direction, and for moving the receiver in a second direction orthogonal to the first direction; and d) control means including a computer coupled to the relative movement means for causing the relative movement means to provide movements in the first and the second directions, and for causing the print head to print a print area in multiple passes in response to the digital image to deliver radiation curable inks in multiple layers to the area of the receiver and for curing each delivered ink layer during each printing pass to thereby produce an image on receiver.

6. The apparatus of claim 5 further including means for mounting the print heads and the radiation means for simultaneous movement in the first direction.

7. The apparatus according to claim 5 wherein the control means include a power supply responsive for controlling the power applied to the UV radiation light source.

* * * * *